US008077102B2

(12) United States Patent
Guy et al.

(10) Patent No.: US 8,077,102 B2
(45) Date of Patent: Dec. 13, 2011

(54) DEPLOYABLE LENS ANTENNA

(75) Inventors: Ronald F. E. Guy, Chelmsford (GB); Bruno P. Pirollo, Chelmsford (GB); Robert A. Lewis, Chelmsford (GB)

(73) Assignee: BAE Systems PLC, London (GB)

( * ) Notice: Subject to any disclaimer, the term of this patent is extended or adjusted under 35 U.S.C. 154(b) by 376 days.

(21) Appl. No.: 12/299,516

(22) PCT Filed: Aug. 8, 2008

(86) PCT No.: PCT/GB2008/050678

§ 371 (c)(1),
(2), (4) Date: Nov. 4, 2008

(87) PCT Pub. No.: WO2009/024813

PCT Pub. Date: Feb. 26, 2009

(65) Prior Publication Data

US 2010/0171673 A1 Jul. 8, 2010

(30) Foreign Application Priority Data

Aug. 22, 2007 (EP) ..... 07270043
Aug. 22, 2007 (GB) ..... 0716356.1

(51) Int. Cl.
*H01Q 19/06* (2006.01)

(52) U.S. Cl. ..... 343/753; 343/755; 369/89; 359/689

(58) Field of Classification Search ..... 396/89, 396/92, 119, 96, 532, 123, 106, 114, 157, 396/111; 359/689, 692, 687, 355, 708, 717, 359/819, 654; 250/201.8, 204, 216, 208.1; 343/753, 755

See application file for complete search history.

(56) References Cited

U.S. PATENT DOCUMENTS 4,721,966 A 1/1988 McGrath
4,899,164 A 2/1990 McGrath (Continued)

FOREIGN PATENT DOCUMENTS

JP 54-72940 11/1977

(Continued)

OTHER PUBLICATIONS

Notification of Transmittal of the International Search Report, PCT International Search Report, and Written Opinion of the International Searching Authority, Dec. 19, 2008, 14 pages.

(Continued)

*Primary Examiner* — Jacob Y Choi
*Assistant Examiner* — Shawn Buchanan
(74) *Attorney, Agent, or Firm* — Pillsbury Winthrop Shaw Pittman LLP

(57) ABSTRACT

A deployable lens is provided for an antenna. The lens comprises an array of metallic lens elements formed on a plurality of planar sections of a dielectric substrate, each lens element comprising a first end-fire element directed towards a feed side of the lens, a second end-fire element directed towards a non-feed side of the lens and a section of transmission line for coupling signals between the first and second end-fire elements. The section of transmission line, preferably in the form of a slot-line transmission line, is integrated with the end-fire elements and is of a length determined according to the position of the lens element within the aperture of the lens as deployed. An antenna is also provided comprising a deployable lens according to the present invention.

17 Claims, 8 Drawing Sheets

U.S. PATENT DOCUMENTS

| | | | | |
|---|---|---|---|---|
| 5,786,792 | A | 7/1998 | Bellus | |
| 6,538,621 | B1 * | 3/2003 | Sievenpiper et al. | 343/909 |
| 6,650,291 | B1 | 11/2003 | West | |
| 7,170,446 | B1 | 1/2007 | West | |
| 2007/0126648 | A1 | 6/2007 | Svensson | |
| 2008/0180341 | A1 * | 7/2008 | Cohen | 343/792.5 |

FOREIGN PATENT DOCUMENTS

| | | | |
|---|---|---|---|
| JP | 56-37702 | | 9/1979 |
| JP | 57-35401 | | 2/1982 |
| JP | 57035401 | A * | 2/1982 |
| JP | 2-108416 | | 8/1990 |
| WO | 2005/011057 | | 2/2005 |
| WO | 2005/064747 | A1 | 7/2005 |
| WO | 2005064747 | | 7/2005 |
| WO | WO 2005/064747 | * | 7/2005 |

OTHER PUBLICATIONS

Miguel Marin et al., "Lens antennas: A study of their potential for satellite missions", Microwave Engineering Europe, Aug. 1, 1992, pp. 23-24 and 27.

Daniel H. Schaubert et al., "Wideband Vivaldi Arrays for Large Aperture Antennas", Perspectives on Radio Astronomy—Technologies for Large Antenna Arrays, Apr. 12, 1999, pp. 49-57.

European Search Report issued in related application 07270043.8, Jan. 22, 2008, 7 pages.

Search Report from UKIPO in related application No. GB0716356.1, Dec. 12, 2007, 3 pages.

Amended Search Report from UKIPO in related application No. GB0716356.1, Dec. 24, 2007, 3 pages.

* cited by examiner

DEPLOYABLE LENS ANTENNA

CROSS REFERENCE TO RELATED APPLICATIONS

This is the U.S. National Phase of PCT/GB2008/050678, filed Aug. 8, 2008, which claims priority to British Application No. 0716356.1, filed Aug. 22, 2007, and European Application No. 07270043.8, filed Aug. 22, 2007, the entire contents of all of which are incorporated herein by reference.

This invention relates to antennas and in particular, but not exclusively, to a lens for a deployable antenna. The present invention finds particular application in large aperture, wideband, deployable antenna structures suitable for space applications operating in the UHF to EHF frequency bands, generally defined as being in the frequency range from 300 MHz to 300 GHz.

Large aperture antennas, particularly those intended for use in space communications applications, are often based upon a large reflector element which may be packed into a relatively compact package and unfurled, once in position, by a suitable deployment mechanism. The deployment mechanism may comprise a mechanical tensioning device or an inflatable support structure, for example. However, reflectors tend to be less tolerant of path length errors, caused for example by deformation of the reflector surface, causing greater phase errors than certain other types of antenna, in particular those based upon radio frequency (RF) lenses.

Large RF dielectric lenses are generally considered unsuitable for space or similar applications as they are difficult to fabricate and to deploy. Certain types of "artificial" lens are known, such as Fresnel lenses, which have been used in certain applications. In particular an artificial lens comprising printed parallel plate waveguides is known to have been used in a large aperture antenna structure.

Another known type of RF lens—a planar lens—typically comprises three layers:—a layer of antenna feed-facing planar elements; a layer of signal paths of varying length; and a layer of non-feed-facing planar elements. The layers of planar elements are interconnected via the signal path layer. The planar array elements in this type of planar lens receive and radiate in a broadside direction. However, in this type of lens, the following constraints generally apply:

- the spacings between the layers must be maintained to high mechanical tolerances;
- there is limited space to introduce long path delays;
- in an active lens heat must be dissipated from an internal layer;
- the lens presents a large surface area, equivalent to the dimensions of the lens aperture, posing a potential problem for large antennas in low earth orbit where atmospheric drag might be significant.

From a first aspect, the present invention resides in a deployable lens for an antenna, comprising an array of metallic lens elements formed on a plurality of interlinked sections of an at least partially flexible dielectric substrate, wherein each lens element comprises a first end-fire element directed towards a feed side of the lens, a second end-fire element directed towards a non-feed side of the lens and a section of transmission line for coupling signals between the first and second end-fire elements, wherein the section of transmission line is arranged to apply a delay to said signals according to the position of the lens element within the aperture of the lens as deployed.

For the purposes of the present patent specification, and as is generally recognised in the art, the term "feed" is intended to refer to any antenna element or group of elements positioned to receive signals or to transmit signals via the lens. A "feed" may also comprise a waveguide positioned and oriented so as to receive or transmit signals via the lens. Thus, the term "feed side" of the lens refers to that side of the lens that faces towards the antenna—towards the antenna feed element (s) or waveguide. The "non-feed side" of the lens is that side facing away from the antenna, towards the Earth in a space application for example.

Preferably, the structure of the lens, when deployed, comprises a cellular structure of open-ended cells wherein one of the lens elements is formed on at least one wall of each cell. The cells are preferably defined by intersections of the plurality of planar sections and the cells are preferably square-sectioned.

The use of end-fire elements in particular enables a lens to be made in the form of an open cellular structure which is not only particularly simple to make and to deploy, but when in the deployed configuration the open-ended cells offer much reduced air resistance in at least one direction in comparison with known planar lens structures; the latter advantage being of interest to applications involving low earth orbits in particular.

The preferred use of square-sectioned cells, in particular, provides for a particularly simple structure that may be collapsed for stowage and may be deployed by means of a simple mechanical extender or an inflatable support structure.

Where only linear polarisation is required, the array of lens elements comprises lens elements formed only on a first plurality of parallel cell walls. For dual polarisation, lens elements may additionally be formed on a second plurality of parallel cell walls which, when the lens is deployed, lie substantially perpendicular to the first plurality of walls.

Preferably, each of the first and second end-fire elements is a Vivaldi end-fire element. Such an element design makes for a particularly simple lens element, especially when the coupling signal path of each lens element is provided by a section of slot-line transmission line integrated with the first and second end-fire elements, as in a preferred embodiment of the present invention. In this case, the entire lens element lies in a single plane and so may be cut into a metal layer applied to only one side of the dielectric substrate.

According to preferred embodiments of the present invention, the section of transmission line of each lens element may be provided by a section of micro-strip transmission line or by a section of strip-line transmission line. These options preserve the substantially planar nature of the lens element. However, the micro-strip option requires a metal layer to be applied to both sides of the dielectric substrate so that the end-fire elements may be cut into the metal on one side of the dielectric substrate and the micro-strip coupling section may be cut from the metal layer on the reverse side of the substrate. The strip-line option requires a slightly more complex structure of two layers of dielectric substrate, each with a metal layer on their outward facing surfaces to accommodate the end-fire elements on one such surface and a ground plane layer on the other such surface. Sandwiched between the dielectric substrate layers, and hence between the end-fire element layer and the ground plane layer, is a section of strip-line conductor which, in conjunction with the outer ground plane layers forms a section of transmission line to couple signals between the end-fire elements, with a appropriate level of delay. However, despite requiring two dielectric substrate layers, optionally a third dielectric layer to maintain precise spacing between the different layers, and three metal layers, the total thickness of the cell walls in the strip-line option need be no more than approximately one fiftieth of a wavelength of the signals that the lens is required to operate with.

According to the requirements for the aperture and focal length of the lens in preferred embodiments of the present invention, the signal path length for each of the lens elements is set so as to provide an appropriate profile of delay across the aperture of the lens to signals passing through the lens. In general, the lens will be required to focus incoming RF signals onto an antenna feed element or into a waveguide or to form a substantially parallel beam of signals from those emitted by an antenna feed element or waveguide by way of output from the antenna.

By increasing the range of signal delays that are applied by lens elements from the edge to the centre of the lens aperture, the focal length of the lens may be reduced. If the required difference in delay makes it difficult to provide a sufficiently long signal path within the preferred length of a lens element, then a so-called "zoned" lens may be provided in which integer multiples of the intended operational wavelength for signals may be removed from the signal path length in lens elements across the lens, as will be discussed in more detail in the description of preferred embodiments below. Alternatively, those lens elements towards the centre of the lens may be made longer and hence the lens may be made locally thicker, enabling the respective lens elements to accommodate a longer signal path length.

In a preferred embodiment of the present invention, one or more passive components are integrated within the signal path of the lens elements. For example, a simple filter may be incorporated. In other applications, it may be desirable to integrate one or more active components within the signal path of the lens elements, for example to provide amplification of other forms of manipulation to signals passing therethrough. Advantageously, the open cell structure of the lens provides a natural route for escaping heat from any such active components.

From a second aspect, the present invention resides in a deployable antenna that uses a deployable lens according to the first aspect of the present invention summarised above and as discussed in more detail below.

From a third aspect, the present invention resides in a method for manufacturing a deployable lens for an antenna, wherein the lens as deployed comprises a cellular structure of open-ended cells, the method comprising the steps of:

(i) from a flexible sheet of dielectric material having a metal layer applied thereto, forming, in the metal layer, one or more rows of lens elements required to form the lens, each lens element comprising a back-to-back pair of end-fire antenna elements;

(ii) selecting a first row and a second row of lens elements from those formed at step (i) comprising those lens elements that will form a given group of cells of lens elements in the lens as deployed and placing those rows in parallel association such that, for a given cell in the lens as deployed, a lens element in the first row that will be adjacent within the cell to a lens element in the second row are aligned;

(iii) bonding the first and second rows together along a bonding line or bonding region associated with each aligned pair of lens elements; and (iv) repeating steps (ii) and (iii) until all rows of lens elements required to form the lens have been selected and bonded together.

Preferably, fold lines are formed in the dielectric material and/or the metal layer between adjacent lens elements such that there is flexing along those fold lines, when the lens is deployed, to enable the respective cells to open.

Preferred embodiments of the present invention will now be described in more detail, by way of example only, with reference to the accompanying drawings of which:

FIG. 1 provides two sectional representations of a deployed lens according to a first embodiment of the present invention;

Figure 7A:
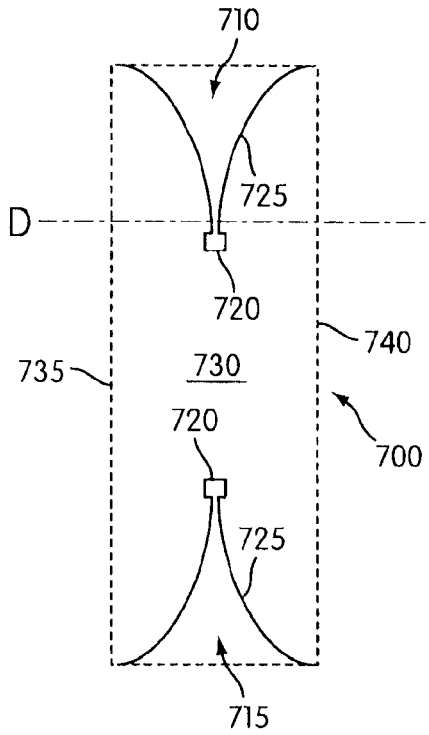

FIG. 7*a* shows a first part of a lens element.

Figure 7B:
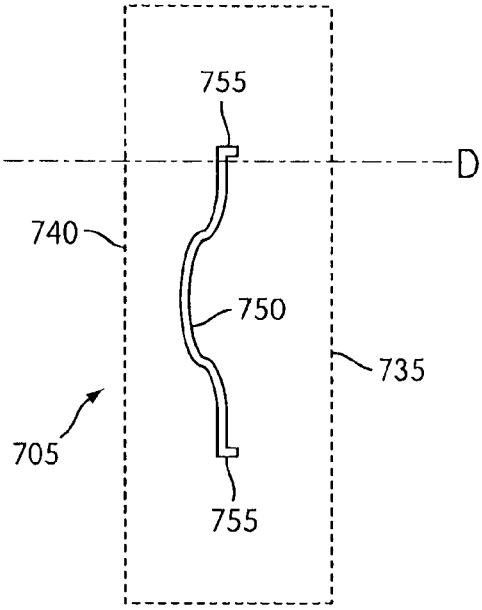

FIG. 7*b* shows a second part of a lens element.

Figure 8:
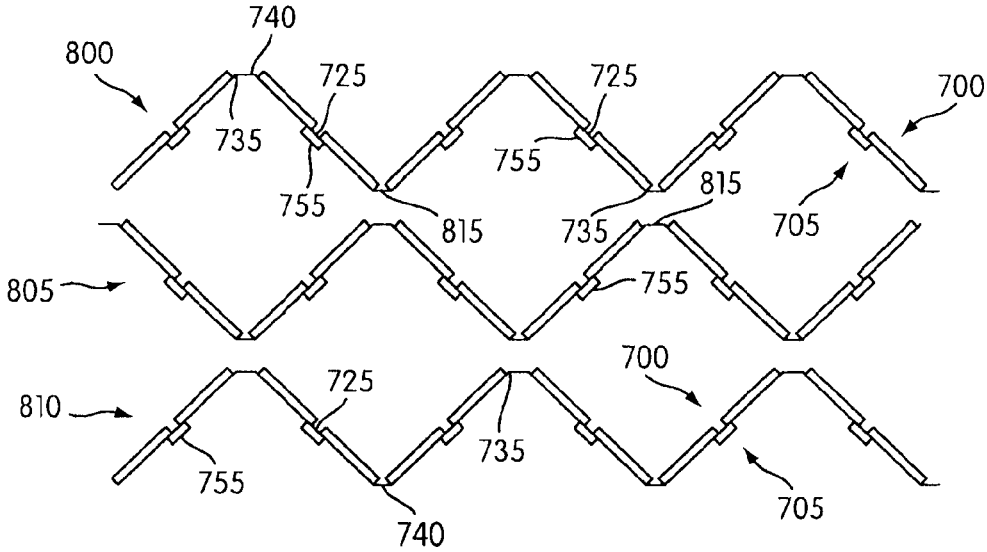

FIG. 8 shows a sectional view through pre-assembled strips of di-electric substrate.

Figures 9A, 9B, 9C:
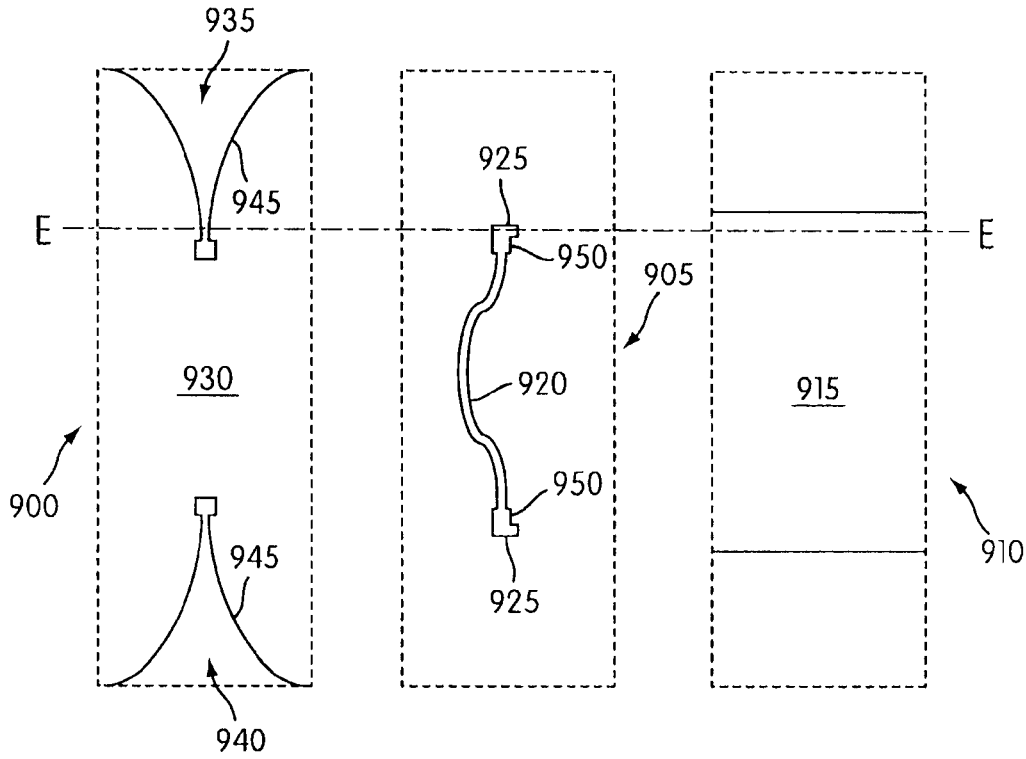

FIGS. 9*a*-9*c* show three parts of a lens element.

Figure 10:
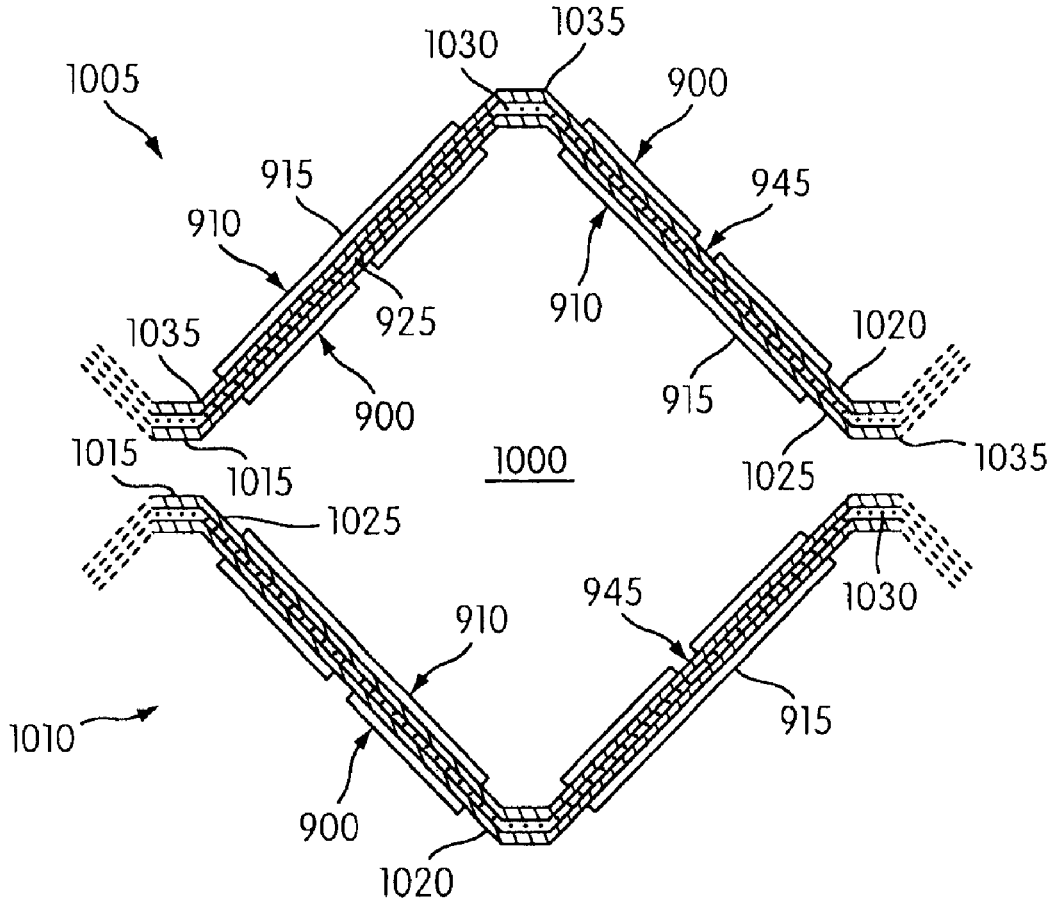

FIG. 10 shows a sectional view through a pre-assembled portion of a lens.

According to a first embodiment of the present invention, a constrained planar end-fire lens is provided for use in a deployable antenna. In the context of the present invention, the term "constrained planar" is intended to mean that the signal paths are constrained to transmission lines (not free space signal paths) and that the end-fire elements terminate in a substantially planar surface across the aperture of the lens on both the feed side and the non-feed side of the lens. Alternatively, in a preferred embodiment of the present invention, the end-fire elements may terminate in a stepped planar surface, on either or both of the feed side and the non-feed side surface of the lens, and this type of surface will be considered for the purposes of the present patent application to fall within the scope of "constrained planar".

The structure of the lens in this first embodiment, being based upon end-fire elements, has been found to be particularly suited to compact stowage and subsequent deployment. Moreover, the method of fabrication of the lens, as will be described in more detail below, is particularly simple in comparison with that for known planar lens structures. In particular, where a large aperture lens is required and the structure comprises a large number of lens elements, the lens elements in a preferred embodiment of the present invention may be simply fabricated on a flexible dielectric substrate as large sheets of elements which may be cut into strips, folded and bonded together along weld lines.

To begin, the structure and the key principles in operation of a lens according to this first embodiment of the present invention will now be described with reference to FIG. 1.

Figure 1A:
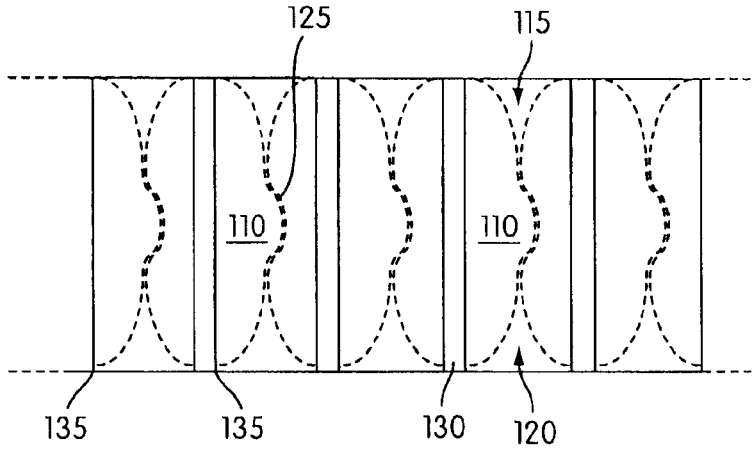
Figure 1B:
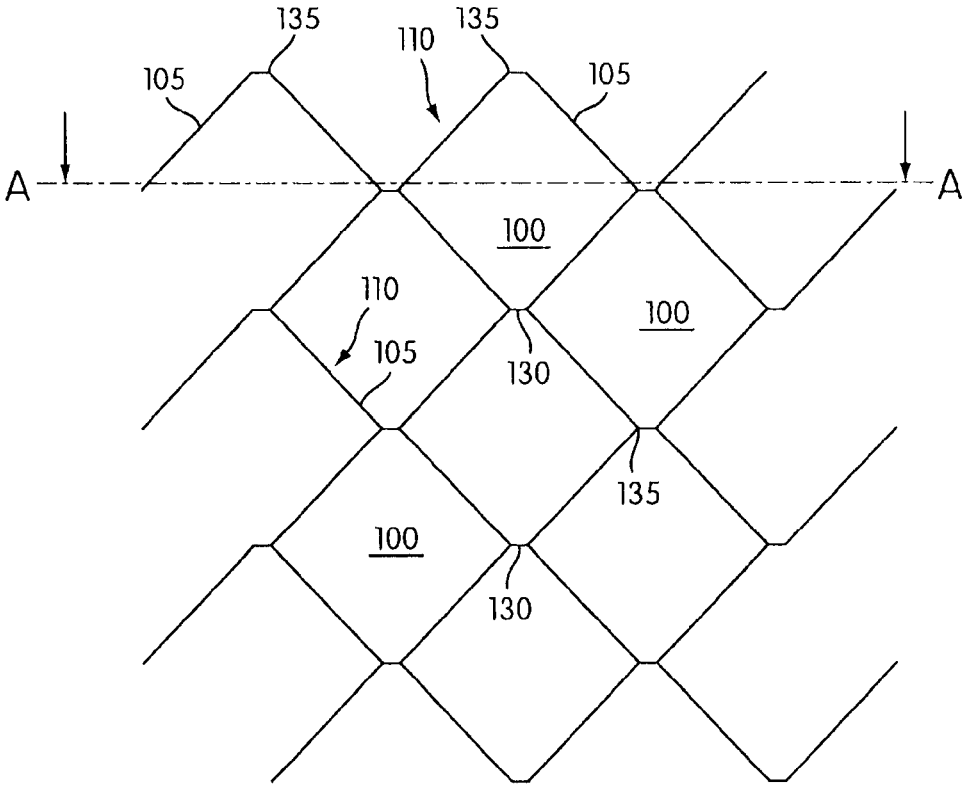

Referring to FIG. 1, two views are provided of a small portion of a lens according to this first embodiment of the present invention when in its deployed state. FIG. 1*a* provides a view through the plane of the lens towards a perpendicular plane indicated by the line A-A in FIG. 1*b*. The structure of the deployed lens when viewed, as in FIG. 1*b*, from a direction substantially perpendicular to the plane of the lens—a typical direction in which radio frequency electromagnetic radiation is received or emitted from the lens—is that of an open-ended cell structure—for example a substantially square-sectioned honeycomb structure. Each cell 100 is essentially a square sectioned tube formed from an at least partially flexible metal-clad dielectric substrate which may be clad on either one side or on both sides. Where a cell wall 105 is clad with metal, an end-fire lens element 110 may be cut or etched into that metal cladding. In this embodiment, the lens element 110 comprises a pair of back-to back planar Vivaldi end-fire elements 115, 120 coupled together by means of a section of slot-line transmission line 125. In general, if the dielectric substrate is metal clad on only one side then there is an opportunity to provide an end-fire lens element 110 on at least two walls 105 of each cell 100. If the dielectric substrate is metal clad on both sides, then there is an opportunity for each wall 105 of every cell to carry an end-fire lens element 110 or for different types of transmission line coupling to be provided between the end-fire elements 115, 120, other than slot-line 125, as will be discussed below.

Thus a signal received by a first Vivaldi element 115 on a receiving side of the lens is coupled by means of the slot-line transmission line 125 to a second Vivaldi element 120 on the transmitting side of the lens where the signal is transmitted. The length of the slot-line transmission line 125 for that particular lens element 110 determines the time delay that is applied to the signal between receipt and transmission by the lens element 110.

Across the aperture of the lens, the length of the slot-line 125 in each of the lens elements 110 is set according to the requirements of the lens to focus incident radiation. In the small section of lens shown in FIG. 1, each of the slot-lines 125 are shown to be of substantially the same length for ease of representation. However, if the lens is required to focus incident radiation onto an antenna feed, such as a waveguide, then the time delay applied by lens elements 110 towards the centre of the lens aperture, and hence the length of slot-line 125 that needs to be fabricated in those lens elements 110, will be greater than that for lens elements 110 towards the edges of the aperture. The minimum delay is applied by a lens element 110 having a substantially straight section of slot-line 125 interconnecting the Vivaldi elements 115, 120. Longer delays are implemented by introducing one or more meanders of appropriate length in the slot-line 125.

As will be described below, the cell-like lens structure is formed and held together by welded or otherwise bonded sections 130 of the metal-clad dielectric substrate, for example by means of weld lines. The width of these welded sections 130 shown in FIG. 1 is exaggerated slightly as the required degree of bonding may in practice be achieved with very much narrower sections 130 than those illustrated. Preferably, a fold line 135 is formed in the metal-clad substrate on either side immediately adjacent to each welded section 130 so that the lens may be collapsed to a substantially flat structure for stowage and subsequently deployed through extension of the structure without introducing unwanted fold lines into the lens elements 110.

As mentioned above, a required delay profile across the aperture of the lens is implemented by providing a different length of slot-line 125 in each lens element 110 according to its distance from the centre of the lens when deployed. Lens elements 110 that lie at substantially the same distance from the centre of the deployed lens have slot-lines of the same length. However, a more coarsely profiled lens may be provided in which lens elements 110 lying in annular regions several lens elements wide are provided with slot-lines of the same length so that the delay profile is more coarsely stepped across the aperture of the lens. Such a delay profile may be tolerable in certain applications and provides for a simpler construction in that a smaller number of different lens elements need to be fabricated.

If the lens is required to have a relatively short focal length such that the range of delays required between the centre and the outer regions of the lens is relatively large, it may not be possible to accommodate a slot-line of the length required for the central lens elements within a lens element of a certain preferred length (corresponding to the thickness of the lens). One possible technique, mentioned above, is to make the lens elements in the central region of the lens longer than those towards the edge of the lens, so that at least one surface, e.g. the feed-side surface of the lens, is stepped to some degree. An alternative technique that may be applied where a large variation in delay is required is to apply zoning to the lens. Zoning is a known technique for containing the thickness of a radio-frequency lens by removing a whole number of wavelengths of the intended operating wavelength from the delays that are applied across different regions of the lens. Thus, the delay profile of lens elements may range from the same minimum delay to the same maximum delay repeatedly, between the outer regions of the lens and the centre of the lens, according to the radial distance from the centre, so that lens elements in no one region of the lens needs to apply a delay outside this range and so exceed a certain predetermined thickness. However, the zoning technique is only suited to relatively narrow bandwidth applications as the zoning is designed with respect to a certain operational wavelength of signals. The performance of the lens can be expected to degrade at operating wavelengths significantly different to the design wavelength.

Two examples of lens elements 110 with different slot-line lengths are shown in and will now be described with reference to FIG. 2.

Figure 2A:
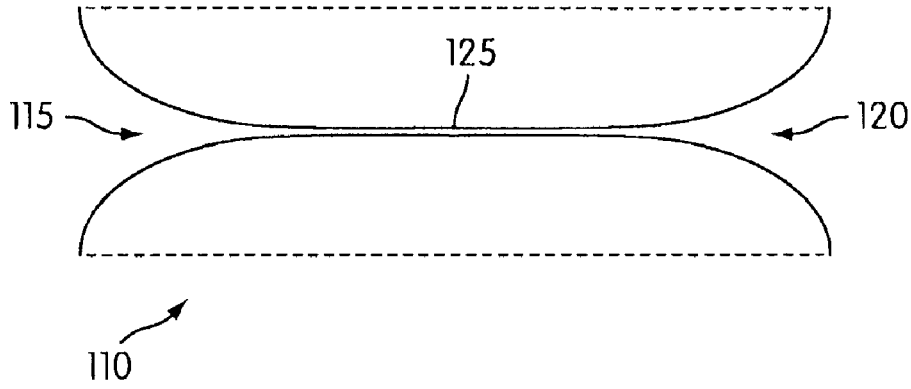
FIG. 2 shows two preferred designs for a lens element for use in preferred embodiments of the present invention.
Figure 2B:
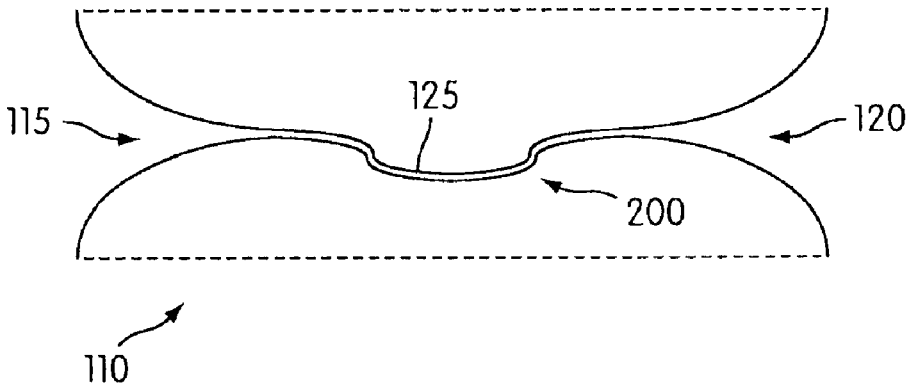

Referring to FIG. 2*a*, a lens element 110 is shown that has been designed to impart a minimal delay to signals passing through the lens. The lens element 110 comprises a straight section of slot-line transmission line 125 coupling the first and second Vivaldi elements 115, 120. In a lens required to focus received signals, for example onto a central region occupied by a receiver, lens elements 110 of the type shown in FIG. 2*a* would be used in the outer cells 100 of the lens aperture. Referring to FIG. 2*b*, a lens element 110 is shown that has been designed to impart a longer delay to signals passing through the lens by means of a longer length of slot-line transmission line 125, in this example achieved with a single meander 200. Of course, yet longer delays may be achieved with further meanders and/or meanders of greater length. Those lens elements 110 having the greatest length of slot-line 125 would be used in cells 100 towards the centre of a focusing lens' aperture. In a focusing lens (as opposed to a diverging lens), the lens elements 110 are provided with increasing lengths of slot-line 125 with increasing proximity to the centre of the lens. The difference in the delay provided by lens elements 110 of the outer cells 100 and those of the central cells 100 is determined by the required focal length of the lens. Of course, for a divergent lens, the slot-line delays would be gradually decreased towards the central region of the lens aperture.

Figure 3:
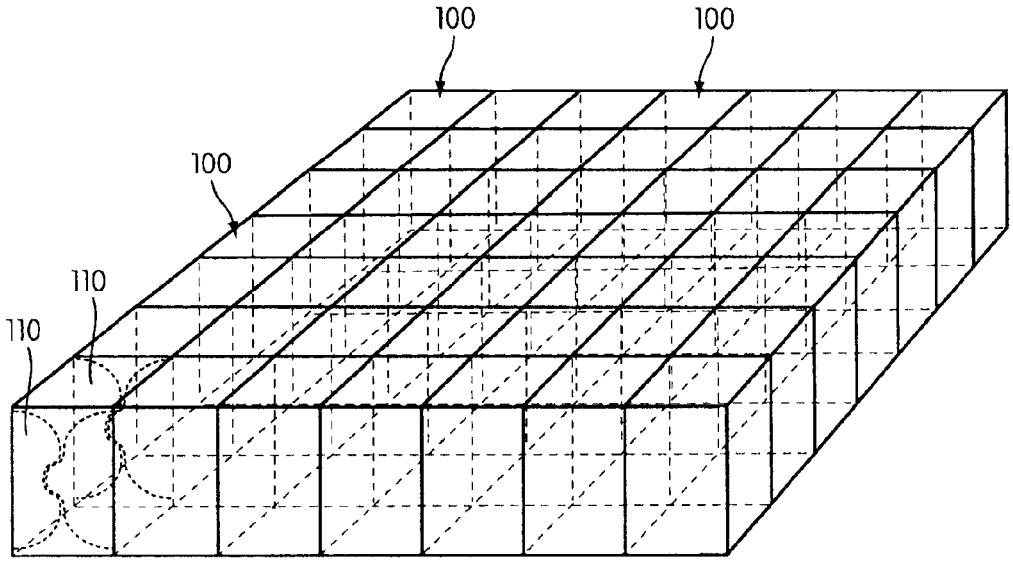
FIG. 3 shows a perspective representation of a deployed lens according to the first embodiment of the present invention.

A perspective representation of a deployed portion of a lens according to this first embodiment is shown in FIG. 3. Referring to FIG. 3, the overall structure of the cells 100 forming the lens can clearly be seen. In the portion of deployed lens shown, for ease of representation, only one of the cells 100 is shown with lens elements 110 formed in two of the walls of the cell 100. In practice all of the cells 100 are intended to carry lens elements 110 in at least two of the walls. In a typical implementation of the lens, there are likely to be many more cells 100 than those represented in FIG. 3.

A preferred method for manufacturing a lens according to this first embodiment will now be described with reference to FIG. 4.

Figure 4:
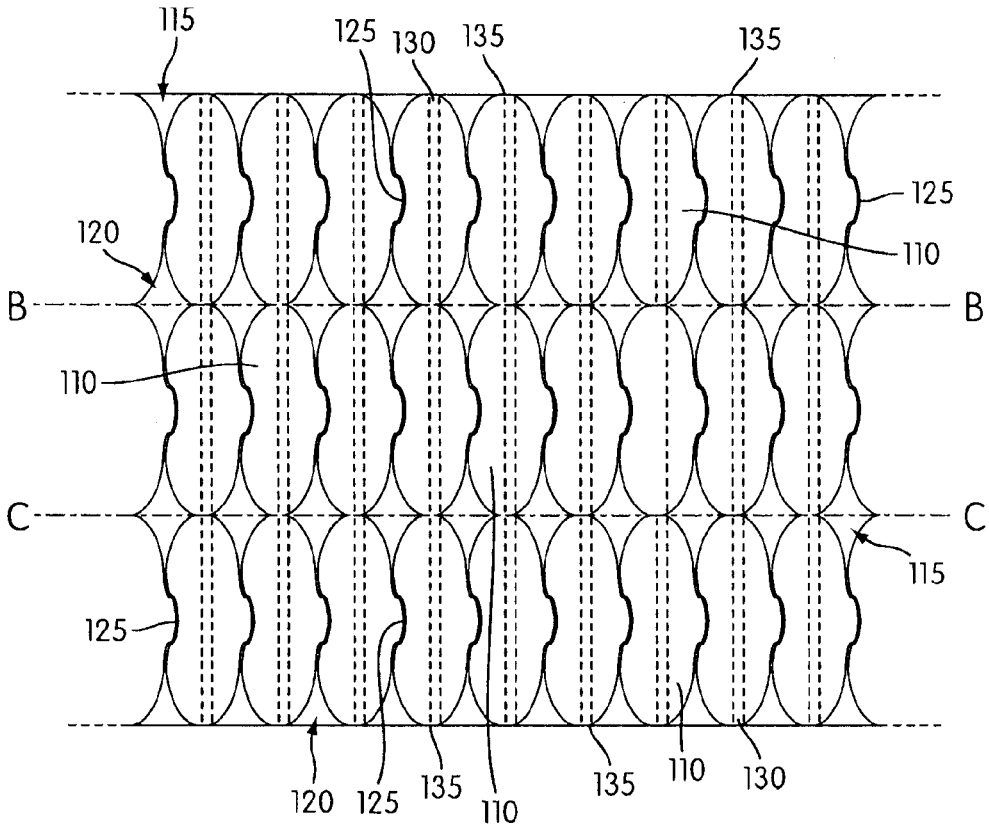
FIG. 4 illustrates a preferred method for manufacturing lens elements for use in making a lens according to the first embodiment of the present invention.

Referring to FIG. 4, a section of a sheet of dielectric material is shown having, for example, a copper or aluminium metal layer applied to one side. Into the metal layer has been cut or etched a sequence of end-fire lens elements 110, each with an appropriate length of slot-line transmission line 125 coupling respective pairs of Vivaldi elements 115, 120. Whereas the lens elements 110 shown in FIG. 4 are provided with the same lengths of slot-line transmission line 125, for ease of representation, in practice each of the lens elements 110 will be provided with a different length of slot-line 125 according to the intended position of the lens element 110 in the assembled and eventually deployed lens. Preferably, and as shown in FIG. 4, the only metal removed from the metal layer is that required to form the end-fire elements 115, 120 and the slot-line coupling 125. When the lens is assembled, the lens elements 110 of adjacent cells are thus electrically connected from a direct current (DC) perspective by continuous metal. Alternatively, gaps may be cut into the metal layer so that the metal lens elements 110 stop short of the corners of their respective cells 100, for example as defined by the fold lines 135. Thus, when the lens is assembled, there is no DC connection between the metal of adjacent lens elements 110.

In the example of FIG. 4, three lines of lens elements have been cut into the metal layer. A pair of fold lines 135 is formed between each lens element 110, either side of what is intended to be a weld line or weld region 130. The substrate is cut along the lines B-B and C-C, before or after folding along the fold lines 135, to separate the lines of lens elements into strips. Strips of lens elements 110 are then placed face-to-face with the intended weld regions 130 aligned and facing one another, as shown in a sectional view in FIG. 5, and with the lens elements 110 correctly positioned according to the delay they are intended to apply to signals in the assembled lens.

Figure 5:
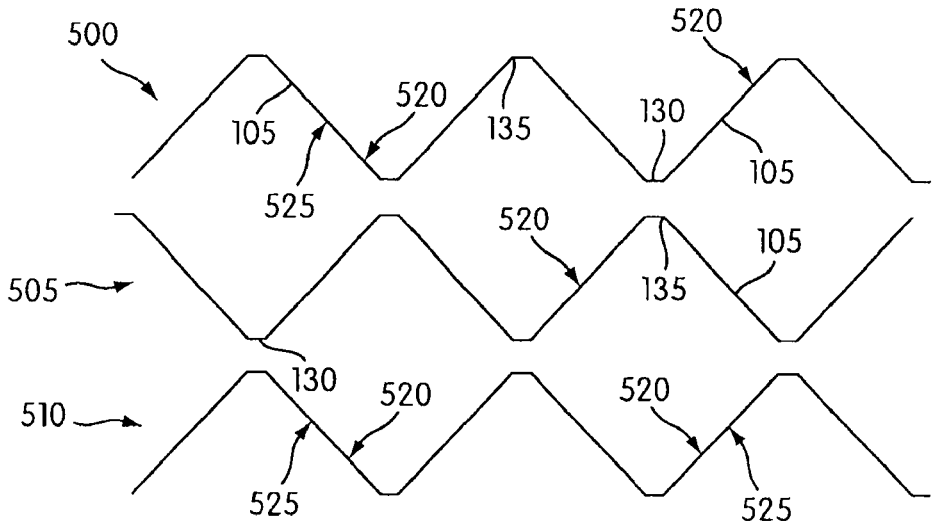
FIG. 5 shows a preferred method for assembling a lens from the lens elements manufactured in accordance with the technique illustrated in FIG. 4.

Referring to FIG. 5, a first, second and third strip, 500, 505 and 510 respectively of lens elements 110 are shown in a sectional view, viewed within the plane of each lens element 110. Each strip 500-510 has been bent along the fold lines 135 and adjacent strips are aligned by their intended weld regions 130 ready to be brought together for bonding. As can be seen in FIG. 5, every alternate weld region 130 is welded or otherwise bonded to that of an adjacent strip. After welding, the resultant structure may be deployed, for example by tensioning or inflation, such that the structure resembles that shown in and described above with reference to FIG. 1 or FIG. 3.

Preferably, the strips 500-510 are placed with their metal faces 520 similarly oriented, and hence their dielectric faces 525 similarly oriented so that all welded regions 130 comprise dielectric-to-metal bonds. Alternatively, the strips 500-510 may be oriented in pairs, metal face 520 to metal face 520, dielectric face 525 to dielectric face 525, such that bonding of materials is like-with-like, i.e. metal to metal and dielectric to dielectric. However, in the event that the dielectric substrate is provided with a metal layer on both sides, all weld regions 130 will have metal surfaces and all welds will thus be metal-to-metal. If metal is removed between lens elements 110 to leave gaps between lens elements 110, then all weld regions 130 will be bare dielectric and all welds will be dielectric-to-dielectric.

It is not necessary that the metal-faced portion 520 of the lens element 110 is flexible to the same degree as that portion in the vicinity of the weld region 130. In a lens structure as described in this first embodiment of the present invention, stowage and deployment of a lens requires only that the dielectric material is able to bend in the region of the fold lines 135.

In this first embodiment of the present invention, the Vivaldi end-fire elements 115, 120 are coupled using a slot-line transmission line 125. There are particular advantages associated with remaining in slot-line for the entire lens element, in particular that of enabling the lens element 110 to be fabricated in a single planar layer of metal. However, the Vivaldi end-fire elements 115, 120 may alternatively be coupled by sections of micro-strip or strip-line transmission line in further preferred embodiments of the present invention, if necessary incorporating a separate delay line. To illustrate the differences between the three transmission line embodiments, the structure of corresponding cells of lens elements, for example in pre-assembly arrangements corresponding to that described above with reference to and as shown in FIG. 5, will now be compared and discussed with reference to FIGS. 6, 7, 8, 9 and 10.

Figure 6:
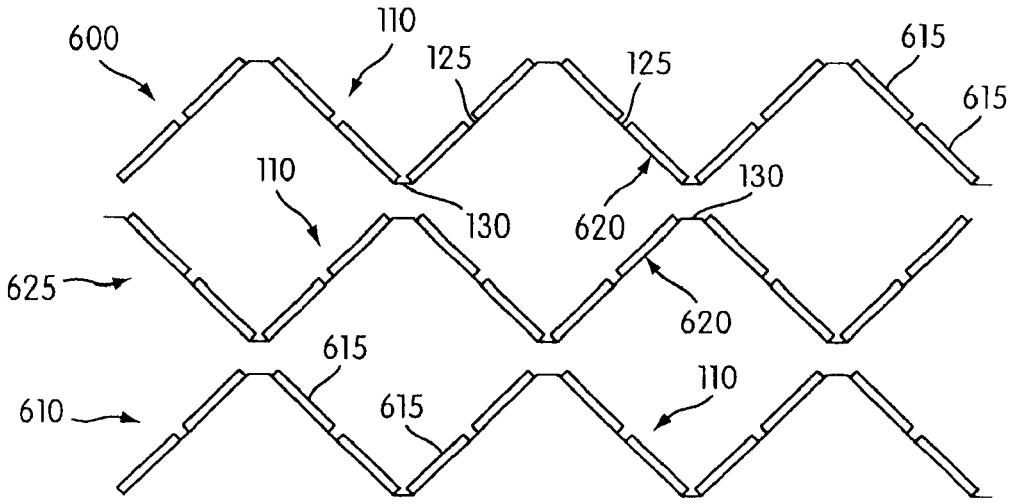
FIG. 6 shows a sectional view corresponding to that shown in FIG. 5.

Referring firstly to FIG. 6, a sectional view corresponding to that shown in FIG. 5 is provided through portions of three strips 600, 605, 610 of dielectric substrate carrying lens elements 110 according to this first embodiment of the present invention, aligned ready for assembly. The dielectric substrate in this embodiment has been clad with metal on only one side and those portions of metal 615 remaining to form the lens elements 110 can be clearly seen in FIG. 6, the thickness of the metal layer being shown with exaggerated sectional thickness in comparison with the thickness of the dielectric substrate 620 for ease of representation. In particular, a sectional view of the gap forming the slot-line transmission line 125 coupling between the end-fire Vivaldi elements can be clearly seen in FIG. 6.

The structure of a lens element, and hence of the lens, comprising end-fire Vivaldi elements coupled by means of a section of micro-strip transmission line will now be described with reference to FIG. 7 and FIG. 8, according to a second embodiment of the present invention. Preferably, the lens element of this second embodiment is constructed from a sheet of dielectric substrate having a metal layer on both sides.

Referring initially to FIG. 7, the lens element is shown to comprise first and second parts 700 and 705 respectively, cut from metal on opposed faces of the dielectric substrate with correct alignment. The views shown in FIG. 7 comprise the two parts 700, 705 of the lens element that lie between the fold lines 735, 740, corresponding to the fold lines 135 in the first embodiment described above. In FIG. 7*a*, the first part 700 is composed of back-to-back Vivaldi end-fire elements 710 and 715 cut from the metal layer on one face of the dielectric substrate. Each Vivaldi element 710, 715 is provided with a small aperture 720 at the base of each tapering slot 725. The only metal cut from this metal layer is that required to form the tapering slots 725 and the apertures 720. The metal 730 remaining between the Vivaldi elements 710, 715 forms a ground plane to a micro-strip conductor formed on the opposed face of the dielectric substrate.

FIG. 7*b* shows the second part 705 of the lens element, comprising the micro-strip conductor 750 cut from the metal layer on that opposed face of the dielectric substrate. The micro-strip conductor 750 corresponds in its function to the section of slot-line 125 in the lens element 110 of the first embodiment described above. That is, it provides an appropriate delay to signals passing between the Vivaldi elements 710, 715, the length of delay being determined by the length of the conductor 750. The length of conductor 750 is varied according to the distance of the lens element from the centre of the lens, as discussed above. Signals received by one of the Vivaldi elements 710, 715 are coupled from the respective Vivaldi element 710, 715 to the micro-strip conductor 750 by means an angled portion 755 formed at the respective end of the micro-strip conductor 750. Having passed along the transmission line section provided by the micro-strip conductor 750 and the corresponding section of ground plane 730, the signal is similarly coupled to the other Vivaldi element 715, 710 for transmission by the lens element.

Referring to FIG. 8, an equivalent sectional view is provided through three pre-assembled strips 800, 805, 810 of dielectric substrate, each carrying lens elements according to this second embodiment of the present invention and each strip 800-810 being aligned with the adjacent strip by its intended weld region 815 ready for assembly. The sectional view provided in FIG. 8 is taken through the plane indicated, for that particular lens element, by the line D-D in FIG. 7. The first and second parts 700 and 705 respectively of each lens element are shown aligned on opposed faces of the metal clad dielectric substrate. As with the view in FIG. 6, referenced above, the thickness of the metal components 730, 750, 755 is exaggerated in comparison with the thickness of the dielectric substrate and with the typically implemented thickness of the metal layer, to more clearly show the features of the lens elements.

The structure of a lens element, and hence of the lens, comprising end-fire Vivaldi elements coupled by means of a section of strip-line transmission line will now be described with reference to FIG. 9 and FIG. 10, according to a third embodiment of the present invention. Whereas the lens elements of the first and second embodiments may be constructed using a single layer of dielectric substrate, the structure of the lens element in this third embodiment requires two layers of a dielectric substrate placed in close proximity to one another so as to sandwich an intermediate strip-line conductor layer, as will now be described.

Referring initially to FIG. 9, the lens element according to this third embodiment is shown to comprise first, second and third parts 900, 905 and 910 respectively. This lens element comprises a "sandwich" of the three parts 900-910, comprising two supporting dielectric layers. Preferably, the first part 900 and the second part 905 are cut from metal layers on opposed faces of a first sheet of dielectric substrate that has a metal layer applied to both faces, as for the lens element of the second embodiment described above. Preferably the third layer 910 is cut from a metal layer applied to only one face of a second sheet of dielectric substrate.

Referring to FIG. 9*a*, the first part 900 of the lens element comprises a pair of back-to-back Vivaldi end-fire elements 935, 940 cut from the metal layer applied to one face of the first dielectric sheet. The Vivaldi elements 935, 940 are separated by an otherwise uninterrupted region of metal 930. The shape of this first part 900 is substantially identical in shape with the first part 700 of the lens element according to the second embodiment above.

Referring to FIG. 9*b*, a section of strip-line conductor 920, of similar shape to that of the micro-strip conductor 750 in the lens element according to the second embodiment described above, is cut from the metal layer on the reverse face of the first dielectric sheet to that of the first part 900. The strip-line conductor 920 is provided with an angled section 925 at each end to provide a coupling to the tapering slot 945 of the corresponding Vivaldi element 935, 940 of the first part 900. Preferably a slightly widened section 950 is provided towards each end of the strip-line conductor 920 for the purpose of impedance matching, as is well known in the art.

Referring to FIG. 9*c*, the third part 910 is shown to comprise a section of metal 915 that has been cut from a metal layer applied to only one face of a second sheet of dielectric substrate. In an alternative arrangement, this second dielectric sheet may have metal layers applied to both faces and the second part 905 may be cut from the metal layer on the reverse face of the second dielectric sheet to that of the third part 915, rather than on the reverse face of the first dielectric sheet. In that situation, the first dielectric sheet would have a metal layer applied to only one face rather than to both faces.

The lens element of this third embodiment is assembled by bringing the first and second dielectric sheets together so that the strip-line conductor 920 is sandwiched between them. The strip-line conductor 920 is thus separated by dielectric layers from the metal sections 930 and 915 of the first and third parts 900, 910 which act as ground plane layers in a section of strip-line transmission line, coupling the Vivaldi elements 935, 940. Preferably, in order to maintain a precise spacing between the two dielectric layers, a third layer of dielectric material, of a different type of dielectric material to that of the first and second layers, may be used as a thin spacer to fill what would otherwise be air gaps in the strip-line conductor layer between the first and second dielectric sheets. Preferably, all three layers of dielectric material are bonded together.

Referring additionally to FIG. 10, a sectional view is provided through a pre-assembled portion of the lens according to this third embodiment of the present invention, this sectional view being through the plane indicated by the line E-E in FIG. 9. All the features in FIG. 10 are shown with exaggerated thickness in comparison with the real implementation, for ease of representation. FIG. 10 shows a single cell 1000 that will be formed when two strips 1005 and 1010 of lens elements are brought together and welded together or otherwise bonded at their weld regions 1015. In this example, two walls of the cell 1000 carry lens elements in which the first part 900, having the Vivaldi elements 934, 940, is within the cell 1000, and two walls carry lens elements associated with an adjacent cell in which the third part 910 is within the cell 1000. The structure of each lens element can be seen to comprise first and second dielectric substrate layers 1020 and 1025 respectively, separated by an intermediate third layer 1030 of a different dielectric material for maintaining a precise spacing between the first and second layers 1020, 1025 and hence between the three corresponding metallic layers of the lens elements. The structure of the lens element according to this third embodiment of the present invention can be clearly seen in FIG. 10 to comprise a strip-line conductor 920, the angled end 925 of which is shown in section, sandwiched between the metal layer of the first part 900 comprising the back-to-back Vivaldi elements 934, 940 and the metal portion 915 of the third part 910.

In the example shown in FIG. 10, the metallic portions of the lens elements are shown to lie within the region of each wall of the cell 1000 bounded by fold lines 1035. In this case the lens elements are electrically isolated for direct current (DC). As discussed above in relation to the first embodiment of the present invention, the metallic portions may alternatively be provided in one continuous layer so that adjacent lens elements are electrically connected for DC and all the weld regions 1015 have metal surfaces.

Whereas one preferred technique has been described for making a lens according to preferred embodiments of the present invention, it will be clear to a person of ordinary skill in this field that other techniques may be used to make a deployable lens of the structure preferred in the present invention, substantially as shown in its deployed state in FIG. 1*b* and in FIG. 3 for example.

The invention claimed is:

1. A deployable lens for an antenna, comprising an array of metallic lens elements formed on a plurality of interlinked sections of an at least partially flexible dielectric substrate, wherein each lens element comprises a first end-fire element directed towards a feed side of the lens, a second end-fire element directed towards a non-feed side of the lens and a section of transmission line for coupling signals between the first and second end-fire elements, wherein the section of transmission line is arranged to apply a delay to said signals according to the position of the lens element within the aperture of the lens as deployed; wherein the structure of the lens when deployed comprises a cellular structure of open-ended cells wherein one of the said lens elements is formed on at least one wall of each cell.

2. A deployable lens according to claim 1, wherein each of said open-ended cells is substantially square-sectioned.

3. A deployable lens according to claim 2, wherein said array of lens elements comprises, when the lens is deployed, lens elements formed on a first plurality of parallel planar cell walls such that, when deployed, the lens is linearly polarised.

4. A deployable lens according to claim 3, wherein said array of lens elements further comprises lens elements formed on a second plurality of parallel planar cell walls substantially perpendicular to said first plurality of parallel cell walls such that, when deployed, the lens is dual polarised.

5. A deployable lens according to claim 1, wherein each of the first and second end-fire elements is a Vivaldi end-fire element.

6. A deployable lens according to claim 5, wherein the coupling transmission line of each lens element is provided by a section of slot-line transmission line integrated with the first and second end-fire elements.

7. A deployable lens according to claim 5, wherein the coupling transmission line of each lens element is provided by a section of micro-strip transmission line.

8. A deployable lens according to claim 5, wherein the coupling transmission line of each lens element is provided by a section of strip-line transmission line.

9. A deployable lens according to claim 8, wherein the dielectric substrate comprises at least two layers of dielectric material.

10. A deployable lens according to claim 1, wherein the profile of delay applied across the aperture of the lens, when the lens is deployed, is zoned.

11. A deployable lens according to claim 1, wherein different lengths of lens element are provided across the aperture of the lens.

12. A deployable lens according to claim 1, wherein the length of the section of transmission line in each of the lens elements is determined so as to provide, when deployed, a predetermined profile of delay across the aperture of the lens to signals passing through the lens.

13. A deployable lens according to claim 1, wherein one or more passive components are integrated with the transmission line of each lens element.

14. A deployable lens according to claim 1, wherein one or more active components are integrated with the transmission line of each lens element.

15. A deployable antenna, comprising a deployable lens according to claim 1.

16. A method for manufacturing a deployable lens for an antenna, the lens comprising an array of metallic lens elements formed on a plurality of interlinked sections of an at least partially flexible dielectric substrate, wherein each lens element comprises a first end-fire element directed towards a feed side of the lens, a second end-fire element directed towards a non-feed side of the lens and a section of transmission line for coupling signals between the first and second end-fire elements, wherein the section of transmission line is arranged to apply a delay to said signals according to the position of the lens element within the aperture of the lens as deployed, wherein the lens as deployed comprises a cellular structure of open-ended cells, wherein one of said lens elements is formed on at least one wall of each cell the method comprising the steps of:

(i) from a flexible sheet of dielectric material having a metal layer applied thereto, forming, in the metal layer, one or more rows of said lens elements required to form the lens, each lens element comprising a back-to-back pair of said end-fire antenna elements;

(ii) selecting a first row and a second row of lens elements from those formed at step (i) comprising those lens elements that will form a given group of cells of lens elements in the lens as deployed and placing said rows in parallel association such that, for a given cell in the lens as deployed, a lens element in the first row that will be adjacent within the cell to a lens element in the second row are aligned;

(iii) bonding the first and second rows together along a bonding line or bonding region associated with each aligned pair of lens elements; and (iv) repeating steps (ii) and (iii) until all rows of lens elements required to form the lens have been selected and bonded together.

17. The method according to claim 16, further comprising the step of forming fold lines in the dielectric material and/or the metal layer between adjacent lens elements such that there is flexing along said fold lines, when the lens is deployed, to enable the respective cells to open.

* * * * *